US005213462A

United States Patent [19]

Loibl

[11] Patent Number: 5,213,462

[45] Date of Patent: May 25, 1993

[54] APPARATUS FOR BINDING LEAVES WITH HEAT

[75] Inventor: Bernd Loibl, Konigsbrunn, Fed. Rep. of Germany

[73] Assignee: Ibico AG, Zurich, Switzerland

[21] Appl. No.: 849,228

[22] Filed: Mar. 11, 1992

[30] Foreign Application Priority Data

Mar. 12, 1991 [CH] Switzerland ..... 736/91

[51] Int. Cl.[5] ..... B42B 5/00

[52] U.S. Cl. ..... 412/33; 412/37; 412/900

[58] Field of Search ..... 412/1, 3, 6, 8, 11, 412/13, 22, 33, 37, 41, 900, 902

[56] References Cited

U.S. PATENT DOCUMENTS

| | | | |
|---|---|---|---|
| 4,009,498 | 3/1977 | Staats et al. | 412/1 |
| 4,678,386 | 7/1987 | Wilholm | 412/8 |
| 4,818,168 | 4/1989 | Battish | 412/37 |
| 4,863,332 | 9/1989 | Wilholm et al. | 412/37 |
| 5,035,561 | 7/1991 | Loibl | 412/33 |

FOREIGN PATENT DOCUMENTS

| | | |
|---|---|---|
| 0330156 | 8/1989 | European Pat. Off. . |
| 3805996 | 9/1988 | Fed. Rep. of Germany . |
| 2189215 | 1/1974 | France . |

*Primary Examiner*—Mark Rosenbaum
*Assistant Examiner*—Willmon Fridie, Jr.
*Attorney, Agent, or Firm*—Blum Kaplan

[57] ABSTRACT

An apparatus for binding page edges with heat includes a cover portion which has the approximate shape of a truncated pyramid and which has a longitudinal opening which is at least partially closed by a pivotably mounted wall is provided. The apparatus includes a longitudinal heat-conducting element of a length generally corresponding to the length of the page edges to be bound. The apparatus further includes an actuator or starting signal to activate an electrical switch when the edges to be bound are contacted with the heating element, indicating that the heating process has started and continues to heat depending on the thickness of the leaves to be bound. The electrical switch is then disconnected, thereby generating a signal indicating the completion of the heating and binding process.

20 Claims, 3 Drawing Sheets

Fig. 1
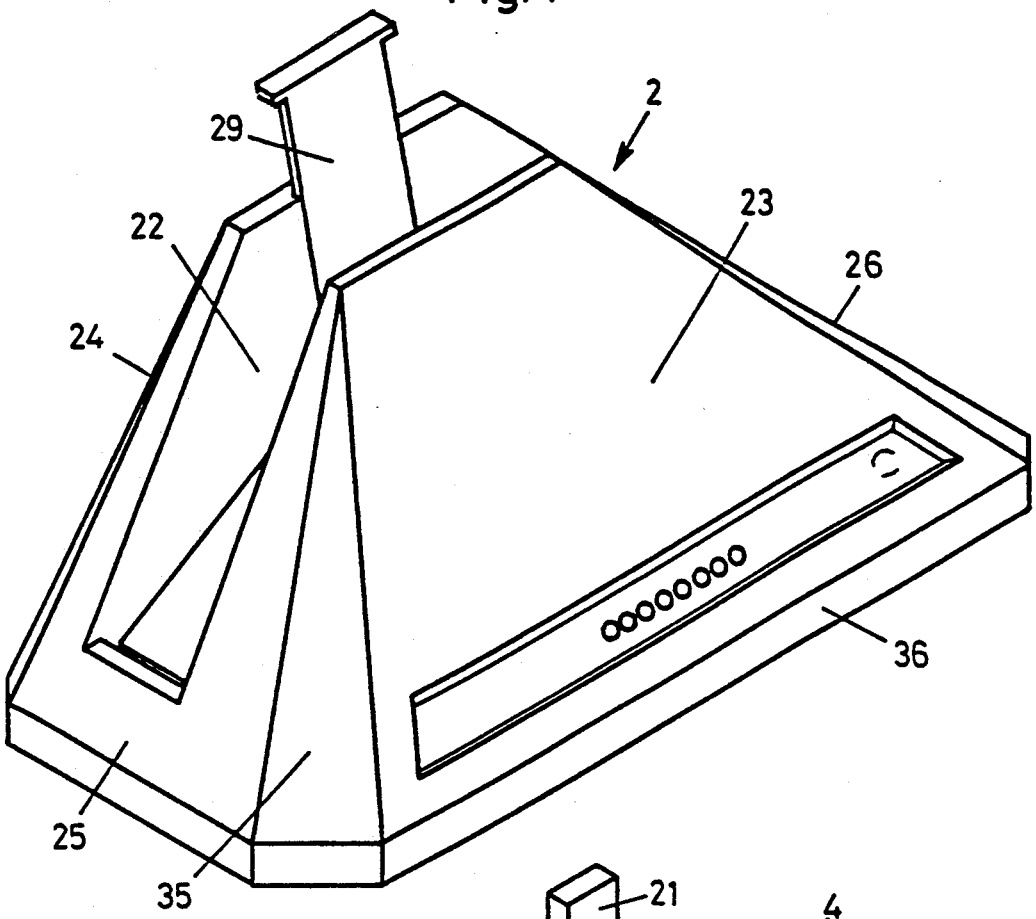
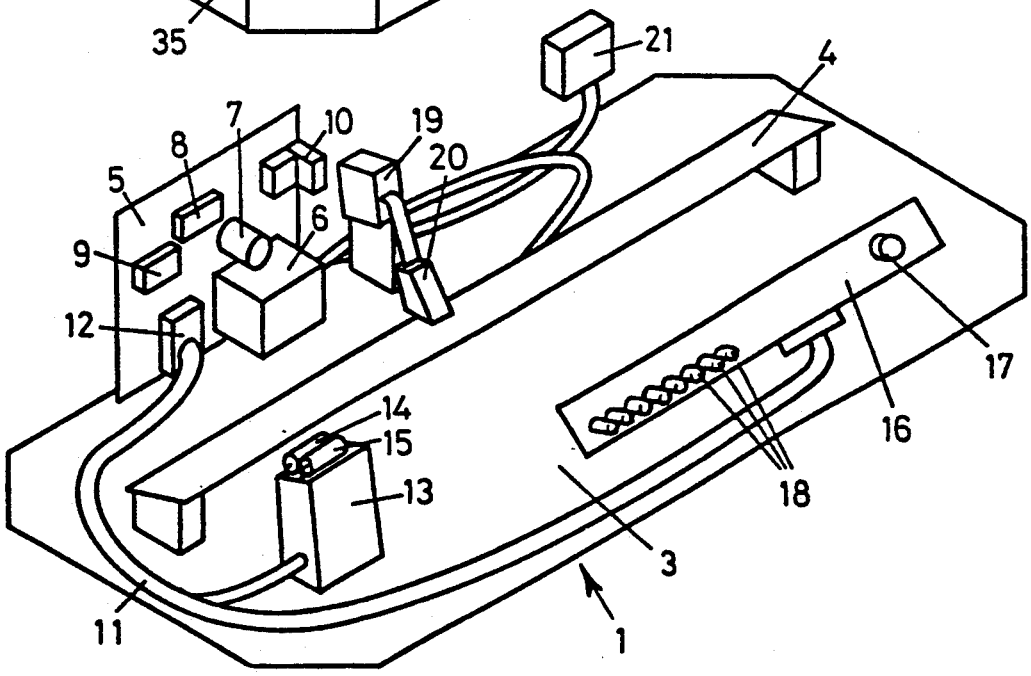
Fig. 2

APPARATUS FOR BINDING LEAVES WITH HEAT

BACKGROUND OF THE INVENTION

This invention is directed to an apparatus for binding the edges of leaves with heat, and in particular, to an apparatus for binding pages with a heat sensitive adhesive attached to at least one such page edge.

Leaves which can be bound with the apparatus include those of paper, cardboard, synthetic material, and the like. Various methods for binding pages together, either just with each other or to an outside cover, are known in the art. They are used to make books, brochures, and the like.

The production of book covers, brochures, and the like or similar processes sometimes involves gluing page edges to the spine of a folder or to the spine of a brochure using a heat-activated adhesive. This results in a thermoplastic bond between the pages or the pages and the folder. One such apparatus which accomplishes this type of thermal binding is described in U.S. Pat. No. 5 035 561. This apparatus is equipped with a longitudinal electrical heating element having a length which conforms to the length of the spine of the leaves to be bound and is used to melt and glue leaves to the spine of the binding to be produced.

The disadvantage of this apparatus is the complexity of the thermostat and temperature control unit.

Accordingly, it is desirable to provide an improved apparatus for producing thermal heat binding.

SUMMARY OF THE INVENTION

Generally speaking, in accordance with the invention, an apparatus for binding pages with heat including a longitudinal heat-conducting element and an actuator which activates an electrical switch when the leaves to be bound are placed on the heating element, thereby indicating that the heating process has commenced. The apparatus also includes an indicator which emits a signal indicating that the heat-conducting element is heated. Additional indicating elements generate indicator signals containing information related to the thickness of the pages to be bound and after a predetermined time dependent on the thickness, the electrical switch is disconnected, thereby generating a signal indicating that the heating and binding process is completed. A pyramid-shaped cover is equipped with a longitudinal opening and is positioned on a base portion of the apparatus such that the longitudinal opening can be at least partially closed by a swiveling wall.

Accordingly, it is an object of the invention to provide an improved apparatus for binding page edges with heat.

Another object of the invention is to provide an apparatus for binding page edges with heat which generates a starting signal when the pages to be bound are placed on the heat-conducting element and which indicates that the heating process has commenced.

A further object of the invention is to provide an apparatus for binding page edges with heat which generates indicator signals related to the thickness of the pages to be bound.

Still another object of the invention is to provide an apparatus for binding page edges with heat which generates a signal indicating that the heating and binding process is completed.

Still another object of the invention is to provide an apparatus for binding page edges with heat which includes a cover having a longitudinal opening which can be at least partially closed by a swiveling wall.

Still other objects and advantages of the invention will in part be obvious and will in part be apparent from the application.

The invention accordingly comprises the several steps and the relation of one or more of such steps with respect to each of the others, and the apparatus embodying features of construction, combinations of elements and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a perspective view of an apparatus for binding page edges with heat constructed and arranged in accordance with the invention;

FIG. 2 is a perspective view of the base portion of the apparatus for binding page edges of FIG. 1;

DESCRIPTION OF THE PREFERRED EMBODIMENTS

Figure 3:
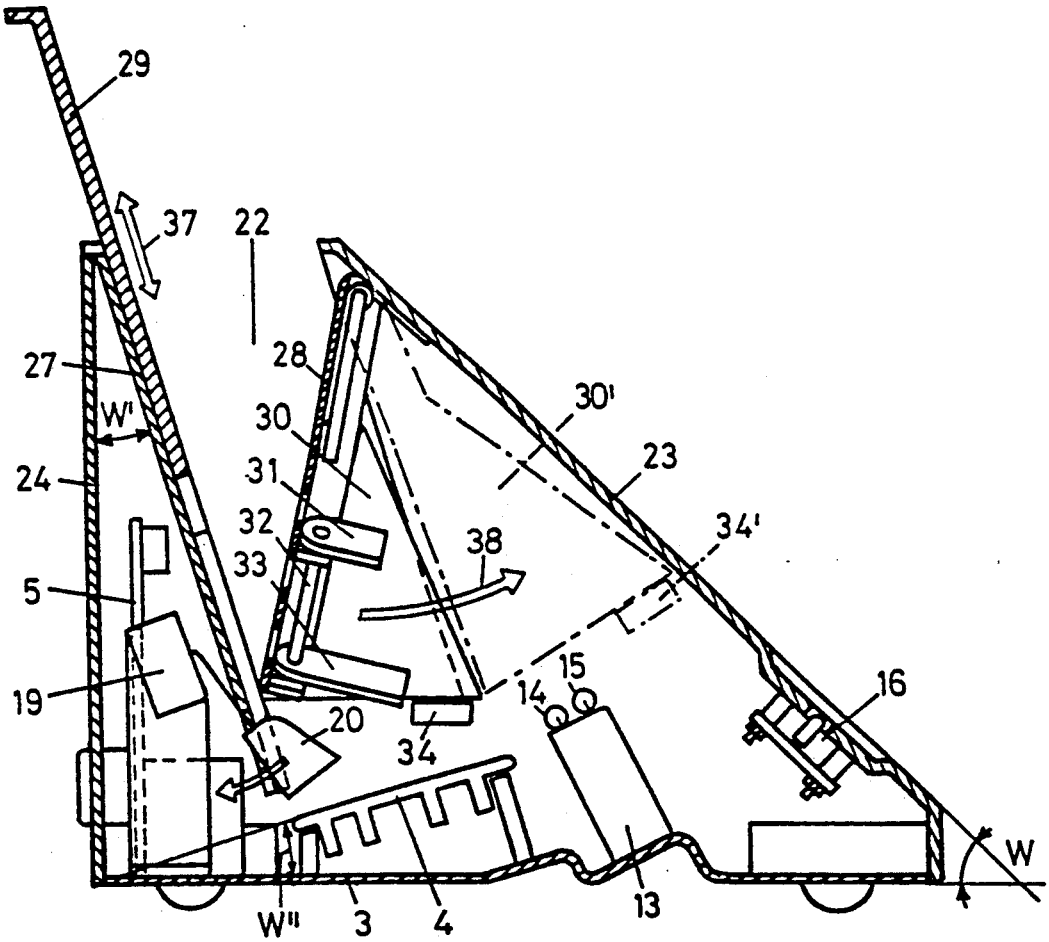
FIG. 3 is a cross-sectional view of the apparatus of FIGS. 1 and 2.

FIGS. 1 and 2 illustrate an apparatus for binding leaves with heat constructed and arranged in accordance with the invention. Binding apparatus includes a cover portion 2 which is positioned on a base portion 1. Base portion 1 and cover portion 2 are held together as a unit by screws, clamping elements or the like. Cover portion 2 includes an opening 22 into which leaves, such as pages, small folders and the like which are to be bound can be inserted with the spine on the inside. The leaves which may be bound may be made of paper, cardboard, plastic, foil or any type such as thin metal foil, or similar materials. The binding apparatus may be used for binding two or more pages to each other or to the spine of a folder or other suitable cover material.

Base portion 1 includes a base plate 3 and a longitudinal heat-conducting element or rail 4 mounted thereon by legs 4'. Rail 4 may be a rail with cooling plates and has an upper longitudinal flat surface which provides support for the spine of the binding. Rail 4 is arranged approximately in the middle of base plate 3 and extends almost over the entire length of base plate 3.

Referring now to FIG. 2, the details of the base portion 1 of the binding apparatus are shown. A printed circuit board 5 is mounted vertically behind rail 4 on the left portion of base plate 3. Printed board 5 includes a transformer 6, an electrolyte condenser 7, two integrated switches 8 and 9, an acoustic radiator or speaker 10 and a plug and socket device 12 which is connected to a cable 11.

Two Reed relays 14 and 15 are mounted on a holder 13 which is mounted on the left end portion of base plate 3, on the opposite or front side of rail 4. As shown in FIGS. 2 and 3, a signal support rail 16 is mounted on a front face 23 in front of rail 4 such that the surface of front face 23 forms an angle W with base plate 3. A switch 17 and several LED or other indicator elements 18 are mounted on support rail 16.

An actuator 19 is positioned within opening 22 about in the center of base plate 3 and behind rail 4. Actuator 19 is equipped with an operating element 20, having a spring. Indicator 18 on support rail 16 and Reed contacts 14 and 15 are connected to printed board 5 by cable 11 and heating elements below rail 4, and a connector 21 are connected by cables 11' and 11".

FIG. 3 shows that front wall 23 of cover 2 is inclined inward at an angle W with respect to base plate 3, and back wall 24 almost vertical to base plate 3. Upper edge of wall 24 is connected to an interior support wall 27 which separates or delimits opening 22 by an angle W'.

Printed board 5 is located in the space between walls 24 and 27. The lower portion of wall 27 includes a small opening such that part of operating element 20 is located in front of wall 27 within opening 22, while actuator 19 is located behind wall 27. The surface of rail 4 is preferably inclined at an angle W" relative to base plate 3, such that W"=W'. The deepest longitudinal edge of rail 4 is positioned slightly below the lowest longitudinal edge of wall 27. A folding or moveable wall 28 is mounted to swivel or pivot on the inside of the short upper edge of front wall 23. Folding wall 28 is forced backwards against a spring such that the lower area of folding wall 28 either contacts or comes in contact with the lower portion of wall 27 or a carrier plate 29 that is placed tangentially on it.

Folding wall 28 may include triangular flaps on the left and the right side such as shown in right flap 30 illustrated in FIG. 3. A magnet 34, preferably a transversely magnetized ferrite magnet, is attached to right flap 30 or directly to wall 28. Right flap 30, which may be springy or designed to swivel, includes corresponding hinges 31, 32 and 33. When wall 28 is displaced, magnet 34 moves with wall 28 and contacts Reed relays 14 and 15.

The lower portion of front wall 23 is formed with an opening 23' for support rail 16. Alternatively, the opening in the lower portion of front wall 23 is provided only for switch 17 and indicator elements 18 which are mounted on support rail 16. Preferably, cover portion 2 includes four beveled edges, such as edges 35 depicted in FIG. 1. Cover portion 2 may also include a plug-and-socket device 36 encompassing the bottom portion thereof.

When a binding apparatus in accordance with the invention is used, operation is as follows. Referring to FIGS. 1 through 3, acoustic radiator or speaker 10 and/or LED elements 18 emit an indicator signal during the time period, $T_1$, required by the apparatus to heat rail 4. The time period $T_1$ to heat rail 4 is about 3 minutes.

If the leaves to be bound are relatively long, a moveable carrier plate 29 slideably mounted on inside rear wall 27 can be pulled upward in the direction of arrow 37 in order to provide better support for the leaves to be bound. When the leaves are inserted into opening 22, operating element 20 is displaced and operates as a micro-switch as shown in FIGS. 2 and 3. Operating element 20 may also include an element having an optical effect. The pressure from the leaves forces micro-switch 20 behind support wall 27 and carrier plate 29 while swiveling wall 28 is simultaneously pressed to the right as indicated by arrow 38. The spine of the leaves are then supported on rail 4. It is preferred that angles W' and W" be about 20° to insure that the leaves rest on support wall 27 or carrier plate 29.

Operating element 20 then emits an acoustic or optical signal indicating that the heating process has started. When the leaves or the pile of leaves to be bound is thick, wall 28 swivels more to the right in the direction of arrow 38. As this occurs, magnet 34 assumes various positions relative to Reed contacts 14 and 15. Magnet 34 can be positioned to contact any Reed relay, only first relay 14 or second relay 15, none or both relays 14 and 15.

If the electronic switch is equipped with a memory, it can distinguish between five positions or pile thicknesses and thus emit an acoustic and/or optical signal which corresponds to five different durations which indicate the end of the heating process. Alternatively, a simpler embodiment which has no memory feature is capable of distinguishing between three positions. In the simpler embodiment, it is preferred that first Reed relay 14 be positioned such that relay 14 is activated when the pile thickness of the pages to be bound is about 15 to 20 mm and second Reed relay 15 be positioned such that relay 15 is activated when the pile thickness is about 40 to 45 mm.

In the event that the operator disregards the respective indicator signal emitted at the end of the heating or binding process, the binding apparatus then emits another indicator signal or extends the previous indicator signal during the time period, $T_2$, which can be set at about 45 minutes when the heating elements are switched off automatically. The heating elements may be arranged as described in U.S. Pat. No. 5 035 561. It is preferred that the heating element be arranged in a double embodiment in which two parallel slits are disposed on the underside of rail 4.

The spring which forces wall 28 to the left as shown in FIG. 3 is of sufficient strength such that the leaves to be bound are not held too loosely, yet is not so strong that the leaves to be bound are held too tightly, thereby restricting the capillary effect of the liquid glue.

A Hall probe may be substituted instead of the Reed relays 14 and 15. Magnet 34 and Reed relays 14 and 15 may alternatively be substituted by an electro-optic device. The actuator 19 may also function according to electro-optical principles.

Figure 4:
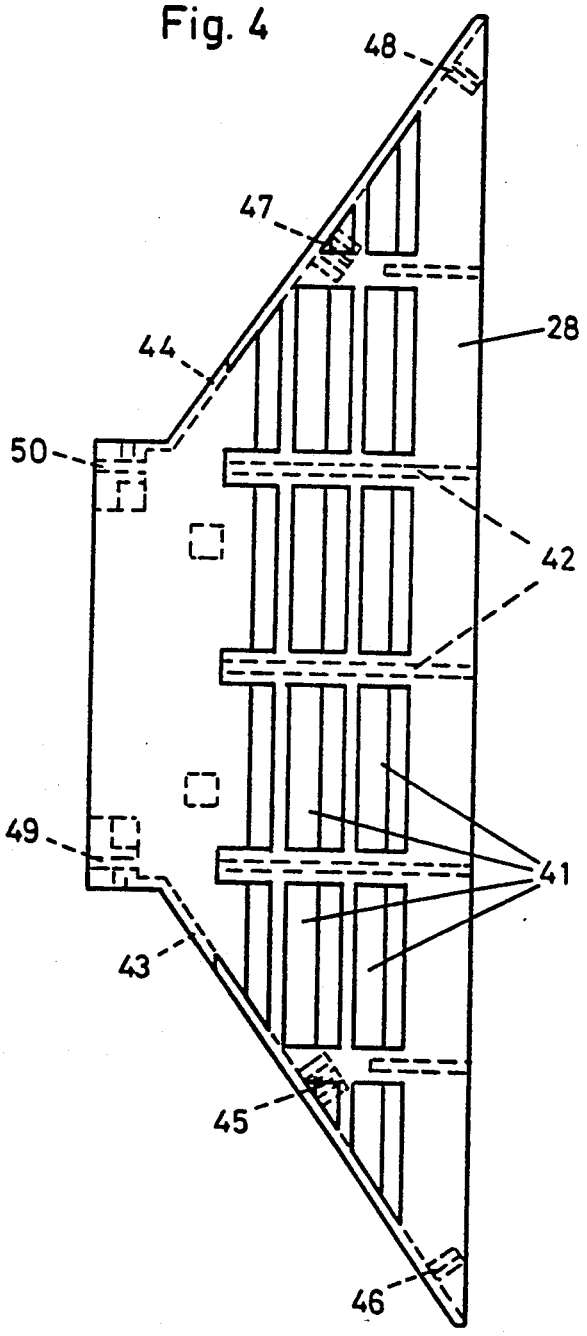
FIG. 4 is a plan view of the moveable interior wall of the apparatus of FIGS. 1 and 3.

Referring to FIG. 4, swiveling wall 28 is a relatively thin trapezoidal synthetic plate having recesses 41 which reduce the weight of the wall. Swiveling wall 28 also includes several ribs 42 which increase the stiffness of wall 28. Thin narrow walls 43 and 44 or expansions are arranged almost vertically to each of the inclined sides of swiveling wall 28. Expansions or walls 43 and 44 act as carriers for respective hinge elements 45, 46 and 47, 48. On the shorter side, swiveling wall 28 includes additional hinge elements 49 and 50 which allow wall 28 to be mounted in such a manner that it swivels in the upper interior area of wall 23. Hinge elements 45, 46 and 47, 48 mount walls 43 and 44 respectively, in such a manner that walls 43 and 44 swivel in the same manner as flap 30 shown in FIG. 3.

Figure 5:
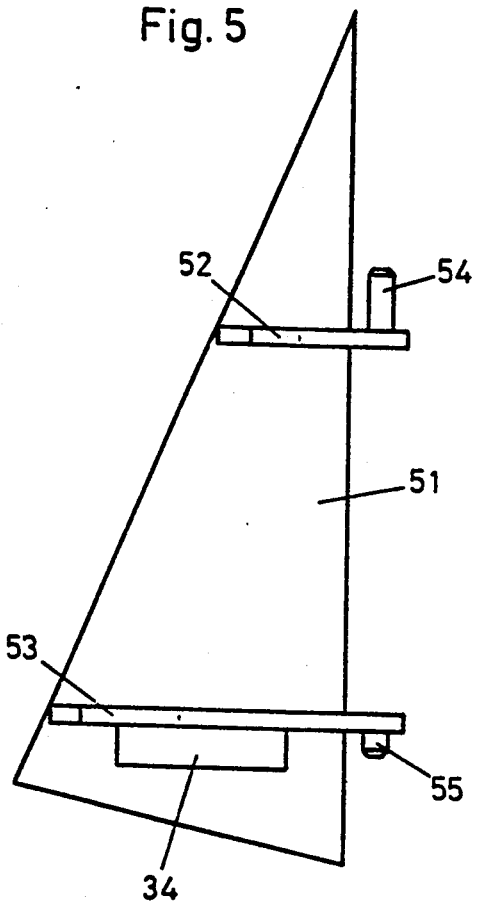
FIG. 5 is a plan view of a side flap coupled to the moveable wall of FIG. 4.
Figure 6:
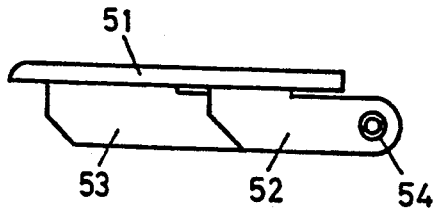
FIG. 6 is a side elevational view of the side flap of FIG. 5.

FIGS. 5 and 6 illustrate flap 30 having a triangular synthetic plate 51 and two ribs 52, 53 which protrude from synthetic plate 51 to form an area containing hinges or swivels 54, 55 which enable synthetic plate 51 to swivel. A small rod 32, such as that shown in FIG. 3, may also be used instead of hinges or swivels 54, 55. As further demonstrated in FIG. 5, magnet 34 is preferably mounted beneath rib 53.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, may as a matter of language might be said to fall therebetween.

What is claimed is:

1. An apparatus for binding the edges of leaves with heat, wherein a heat sensitive adhesive is attached to at least one such edge, comprising:

a longitudinal heat-conducting element of a length generally corresponding to the length of the edges to be bound;

a cover defining a longitudinal opening with the longitudinal heat-conducting element disposed within the longitudinal opening for receiving the leaves to be bound;

activating means for activating an electrical circuit when the leaves to be bound are placed within the longitudinal opening on the heat-conducting element;

first thickness indicating means for generating a signal indicating a thickness of the leaves to be bound, the thickness indicating means including an interior wall pivotally mounted proximate to the opening and distal from the heat-conducting element; and wherein in an inoperative position, the interior wall is pivotally biased in a region over the heat conducting element, so that the longitudinal opening is at least partially closed.

2. The binding apparatus of claim 1, wherein said cover is the shape of a truncated pyramid and includes a front wall and a rear wall defining said longitudinal opening therebetween, and wherein the interior wall is substantially trapezoidal and is smaller than the front wall.

3. An apparatus for binding the edges of leaves with heat, wherein a heat sensitive adhesive is attached to at least one such edge, comprising:

a longitudinal heat-conducting element of a length generally corresponding to the length of the edges to be bound;

activating means for activating an electrical circuit when the leaves to be bound are placed on the heat-conducting element;

first thickness indicating means for generating a signal indicating a thickness of the leaves to be bound;

timing means for generating a signal indicating completion of the heating process based on the signal indicating thickness of the leaves to be bound; and a cover formed with a longitudinal opening with the heat conducting element exposed within the longitudinal opening for receiving the leaves to be bound; and the longitudinal opening being partially closed by a first interior wall pivotably mounted at a portion of the opening away from the heat-conducting element and biased toward the opposed wall defining the opening.

4. The binding apparatus of claim 3, wherein the wall includes thickness indicia means for detecting the thickness of the leaves to be bound in response to displacement of the wall.

5. The binding apparatus of claim 4, wherein the thickness indicia means include at least one magnet mounted thereon.

6. The binding apparatus of claim 3, wherein the longitudinal opening is defined by a second stationary wall having a carrier plate slideably mounted thereon for movement out of the opening to support the leaves to be bound.

7. The binding apparatus of claim 6, wherein the second wall has an angle relative to a reference level extending vertically to the base of the apparatus.

8. The binding apparatus of claim 1, wherein the first indicating means includes at least one Reed relay switch.

9. The binding apparatus of claim 3, wherein the activating means is an operating element disposed in the interior region of the longitudinal opening.

10. The binding apparatus of claim 9, wherein the operating element is a displaceable switch member.

11. The binding apparatus of claim 9, wherein the operating element is an optical switch.

12. The binding apparatus of claim 1, further including a base, the heating element forms an angle with the base.

13. The binding apparatus of claim 12, wherein the angle is about 20°.

14. The binding apparatus of claim 12, wherein a first wall defining said elongated opening is at an angle facing a heating surface of the heat-conducting element.

15. The binding apparatus of claim 14, wherein the interior wall is biased toward the first wall for holding the leaves therebetween.

16. The binding apparatus of claim 1, wherein the heat-conducting element is a rail having two longitudinal grooves disposed on the underside thereof for mounting cooling elements.

17. The binding apparatus of claim 1, further including at least one of optical and acoustic indicating elements to signal starting and completion of heating.

18. The binding apparatus of claim 2, wherein the pivotal axis of the interior wall is located in the region of the shorter side of the interior wall and in the region of the shorter side of the trapezoid-shaped front wall.

19. The binding apparatus of claim 18, further including a triangular plate having a part of said activating means located therein said triangular plate pivotably mounted on at least one of the inclined sides of the trapezoid-shaped wall.

20. The binding apparatus of claim 1, wherein the activating means are for activating an electric switch when the leaves to be bound are placed on the heat-conducting element; and further comprising timing means for generating a signal indicating completion of the heating process based on the signal indicating thickness of the leaves to be bound.

* * * * *